US007325362B1

(12) United States Patent
Rowland

(10) Patent No.: US 7,325,362 B1
(45) Date of Patent: Feb. 5, 2008

(54) STEEL ROOF TRUSS SYSTEM

(76) Inventor: David Rowland, 19733 Dubose Rd., Summerdale, AL (US) 36580

( * ) Notice: Subject to any disclaimer, the term of this patent is extended or adjusted under 35 U.S.C. 154(b) by 319 days.

(21) Appl. No.: 11/005,431

(22) Filed: Dec. 6, 2004

(51) Int. Cl.
*E04B 7/04* (2006.01)

(52) U.S. Cl. ..... 52/93.2; 52/93.1; 52/92.2; 52/92.1; 52/634; 52/639; 52/643; 52/94

(58) Field of Classification Search ..... 52/93.1, 52/93.2, 92.2, 92.1, 643, 620, 634, 639
See application file for complete search history.

(56) References Cited

U.S. PATENT DOCUMENTS 2,982,055 A 5/1961 Thompson
3,256,652 A 6/1966 Lely
3,605,350 A 9/1971 Bowers
4,187,652 A * 2/1980 Bobrovnikov et al. ..... 52/90.1
4,545,159 A 10/1985 Rizk
4,679,967 A 7/1987 Hipkins, Sr. et al.
4,809,480 A * 3/1989 Hale ..... 52/702
5,419,089 A 5/1995 Hill
5,660,005 A * 8/1997 Tacoma ..... 52/93.2
5,970,672 A 10/1999 Robinson
5,988,578 A 11/1999 Davies
6,052,953 A * 4/2000 Jewell ..... 52/93.1
6,240,682 B1 6/2001 James et al.
6,438,920 B1 * 8/2002 Tobey et al. ..... 52/639
6,470,632 B1 * 10/2002 Smith ..... 52/92.2
6,643,981 B2 * 11/2003 Pina et al. ..... 52/91.2
6,691,488 B2 * 2/2004 Branson ..... 52/745.01

* cited by examiner

*Primary Examiner*—Jeanette Chapman
*Assistant Examiner*—Dan Kenny
(74) *Attorney, Agent, or Firm*—Michael I Kroll

(57) ABSTRACT

A truss system and method for use in constructing a building structure comprising a first and second truss member connected to one another a distal end thereof thereby forming a peak joint. A cross bar is connected to each of the first and second truss members at an under side of the peak joint and a sleeve is connected to each of the first truss member and the second truss member at an end opposite the peak joint. Upon securing the cross bar to the first and second truss members, a truss unit is formed wherein a support member is received by the sleeves of each one of the truss units, and upon securing the support members to one another, the truss units form a frame of the building structure.

11 Claims, 10 Drawing Sheets

STEEL ROOF TRUSS SYSTEM

BACKGROUND OF THE INVENTION

1. Field of the Invention

The present invention relates generally to building systems and, more specifically, to a truss and a system of fabricating a building using the truss system of the present invention. The truss is designed to span large widths without center support. Each truss structure is made with two symmetrical truss members that join at the peak joint. A cross brace is located between the two truss members. Attached at the lower ends of the truss members are sleeves. The sleeves are rigidly attached to the truss ends and redirect outward forces into the top of posts in downward forces. The sleeves are designed to slide over the top of posts to attach and properly position the truss on the posts.

2. Description of the Prior Art

Numerous other truss fabrication systems designed for the same purpose exist in the prior art. Typical of these are U.S. Pat. Nos. 2,982,055; 3,256,652; 3,605,350; 4,545,159; 4,679,967; 5,419,089; 5,970,672; 5,988,578; 6,240,682; and 6,438,920. While these truss fabrication systems may be suitable for the purposes for which they were designed, they would not be as suitable for the purposes of the present invention, as hereinafter described.

U.S. Pat. No. 2,982,055

Inventor: Harold D. Thompson

Issued: May 2, 1961

A truss comprising a top and bottom chord each formed from sheet metal structure members with the top chord formed from a member comprising a web and flange portions arranged to form a "U" in cross section, said chords fastened together by an assembly comprising a unshaped pressure clip at least partially nestled in and attached to the top chord over a substantial area which will transmit the expected longitudinal load on the top chord to the clip, said clip having an abutment face on the side of the clip closest to the end of the truss adjacent the fastening assembly, a stop clip at least partially nestled in the top chord and having an abutment face in engagement with the abutment face on the pressure clip, said stop clip attached to the bottom chord over a substantial area which will transmit the expected longitudinal load on the top chord from the stop clip to the bottom chord, and means releasably securing the chord to each other to hold the truss in assembled form without transmitting a substantial portion of the load from the top to the bottom chord.

U.S. Pat. No. 3,256,652

Inventor: Cornelis Van der Lely

Issued: Jun. 21, 1966

A building having at least one story and comprising a plurality of prefabricated box shaped elements, each of said elements contributing to the commutual space of the building, each of said elements being provided with vertical and horizontal sides and a framework of vertical and horizontal metal beams in the form of a parallelepiped, a wall of concrete secured to said vertical beams of said framework, a floor connected to the lower of said horizontal beams of said framework, the topmost elements of the building each having at least part of a roof, a ceiling secured to the higher of said horizontal beams of said frame work beneath said roof, said higher beams being channel beams with the beams of adjacent elements being disposed in a back-to-back relationship, fastening means through said channel beams connecting the frameworks of adjacent elements to one another, said roof including board means supported by said channel beams, waterproof material disposed over said board means of adjacent elements, said waterproof material bent over edges of said board means adjacent the place said channel beams are connected, said channel filled with adhesive filling material, and a waterproofing sheet of material secured across said filling material to said first-mentioned waterproof material.

U.S. Pat. No. 3,605,350

Inventor: William Stewart Bowers

Issued: Sep. 20, 1971

A relocatable, open-span modular building structure which comprises at least two modular sections having integral frameworks defined open-span interiors, means joining said frameworks together, the frameworks of said sections each includes a pair of lower side beams having ends and a generally central portion, and wherein at least one of said sections is provided with laterally extending plates secured to a beam inwardly from the ends thereof for supporting the generally central portion of the side beam of the other section.

U.S. Pat. No. 4,545,159

Inventor: Jihad F. Rizk

Issued: Oct. 8, 1985

A transportable building module including a load-bearing support frame which includes a pair of spaced apart portal frames, a floor frame and a roof frame. The floor frame includes two elongated open web trusses having tubular floor purlins secured in spaced relationship therebetween. Reinforcing floor elements are secured to the upper surfaces of the open web trusses and the floor purlins. Reinforcing mesh is draped across the area of the frame to receive a reinforced concrete slab floor with the mesh being received around the upstanding reinforcing elements. Clip elements may be received around peripheral reinforcing elements, if needed for peripheral reinforcement, and a concrete slab is produced in situ about the floor frame, encapsulating the reinforcing elements, which concrete floor will undergo transit of the building module without damage. The roof frame includes longitudinal tubular beams with roof purlins secured therebetween, the purlins having a predetermined slope across the width of the module, such that a roof secured thereto will have a like slope. Non-load bearing exterior and interior wall structures are secured to the load bearing support frame system which conceal the structural elements of the frame. Each individual module is virtually complete when it leaves the factory and has structural integrity, such that connections between adjacent modules generally do not require structural connections other than necessary to ensure coplanarity of adjacent surfaces.

U.S. Pat. No. 4,679,967

Inventor: Edward C. Hipkins Sr. et al.

Issued: Jul. 14, 1987

A truss bracket for use in a mine roof support system using double tie bars. The truss bracket comprises a substantially flat, planar member for engagement with the mine roof, and an extension depending normal to the planar member. The extension has an angularly disposed channel in communication with an aperture in the planar member. The channel and aperture accommodate a rib or anchor bolt for attachment of the truss bracket. The extension also includes a pair of openings spaced from each other and from the planar member. Each of the openings accommodates a tie bar in parallel relationship to the planar member and to each other. Most preferably, the truss bracket further comprises a tie bar support ring angularly attached to the planar member to accommodate a tie bar in the event of sagging.

U.S. Pat. No. 5,419,089

Inventor: Lionel D. Hill

Issued: May 30, 1995

Steel framing is provided for a building construction having a roof structure [80] and perimeter supporting posts [89] of roll formed steel sections. The connections between the perimeter posts [89] and the roof structure [80] are formed by separate connector assemblies [60] each having post mounting brackets [63] enabling each connector [60] to be bolted to the top of a respective the perimeter post [89], roof frame mounting brackets [61] enabling each connector to be bolted to a respective inclined roof frame member [92] extending inwardly from the respective perimeter posts [89], and perimeter beam mounting brackets [64] enabling adjacent perimeter posts [89] to be interconnected by perimeter beams [91] bolted to the perimeter beam mounting brackets [60].

U.S. Pat. No. 5,970,672

Inventor: Gerald Robinson

Issued: Oct. 26, 1999

A building system and/or an erected building is based on a kit of parts including portable, prefabricated wall sections of a width of 4 feet and a height dependent on the room height desired. The sections include a metal frame having parallel members to be vertical in the erected building. These members are provided with a thermal break along their length. The thermal break may also serve as a water resistant connector between sections. Sections are aligned with abutting side edges to form walls of the building. Parallel abutting vertical members of adjacent sections form composite load bearing members for roof trusses which may be spaced apart by the width of a wall section. A hinged template for interior partitions may be provided which can be folded for transport. Ceiling panels may be connected to roof trusses through an adjustable linkage so that compensation for movement of the roof trusses is possible.

U.S. Pat. No. 5,988,578

Inventor: Robert W. Davies

Issued: Nov. 23, 1999

A roof mounted support bracket which provides a horizontal surface on which materials can be loaded by fork lift from ground level. The roof mounted support brackets can be attached either to a truss or to the rafters during the early phases of roof construction or can be mounted to a roof surface after sheathing or other roofing materials have been applied. The roof mounted support bracket is adjustable for varying pitches of roof, and can receive a support brace from below the roof.

U.S. Pat. No. 6,240,682

Inventor: Stephen Mark James et al.

Issued: Jun. 5, 2001

Roofing structure includes roofing brackets having a first leg attached to vertical members of a roof structure and a second leg that extends at an angle from the first leg and attached to horizontal members of the roof structure. Brackets serve to attach the vertical members to a support surface of the roof. The first and second legs include a plurality of preformed patterned holes and slots having varying sizes to receive fasteners. The pattern and size of the holes and slots allows for fastening of the brackets to steel bar joists while enabling the fasteners in the slots to be fastened near center lines of the respective bar joists. The slot sizes and positions enable fastening to steel bar joists for most distances between the flanges of their top angle chord members.

U.S. Pat. No. 6,438,920

Inventor: Russel J. Tobey et al.

Issued: Aug. 27, 2002

A hybrid truss and a system of fabricating a building using a hybrid truss is provided. The hybrid truss is designed to span large widths without center support. Each hybrid truss is typically made with two symmetrical truss members that join at the peak. Each member is made with an upper cord and a lower cord having cross bracing between the two cords. A peak end member is attached to the ends of the cords to join the two truss members at the peak to form the hybrid truss. Attached at the lower end of each truss member is a sleeve. The sleeve is rigidly attached to at least the lower cords and cross bracing. The sleeve redirects outward forces into the top of a post in a downward force and a slight rotational force. The sleeve is designed to slide over the top of a post or column to attach and properly position the truss on the top of the posts or columns. Vertical adjustment to level the hybrid truss is provided by vertical movement of the sleeve on the post. Once all the posts are placed, and cut to a generally level height, the hybrid trusses are lifted and placed on the posts with the sleeve fitting over the top of the posts. The sleeve, after being vertically adjusted, is secured to the post with bolts, screws, nails or other fasteners. Backing 2.times.4 or 2.times.6's are attached across the top cord and to the outside of the posts. Roofing material and wall material are attached to the backing to enclose the building. The hybrid truss with the sleeve and this method allows a building to be constructed very rapidly and inexpensively. Site preparation is minimized, in that the land does not have to be leveled. There is no need for a concrete floor, foundation or footing. A building having a large width or span with high overhead clearance can be constructed in a very short time using the hybrid truss and the system of fabricating a building with the hybrid truss.

SUMMARY OF THE PRESENT INVENTION

The present invention relates generally to building systems and, more specifically, to a truss and a system of fabricating a building using the truss system of the present invention. The truss is designed to span large widths without center support. Each truss structure is made with two symmetrical truss members that join at the peak joint. A cross brace is located between the two truss members. Attached at the lower ends of the truss members are sleeves. The sleeves are rigidly attached to the truss ends and redirect outward forces into the top of posts in downward forces. The sleeves are designed to slide over the top of posts to attach and properly position the truss on the posts.

A primary object of the present invention is to provide a truss and system of fabricating a building that overcomes the shortcomings of the prior art.

A primary object of the present invention is to provide a truss and system of fabricating a building that is designed to span large widths without center support.

Another object of the present invention is to provide a truss and system of fabricating a building that each truss member is made with two symmetrical truss members that join at the peak.

Yet another object of the present invention is to provide a truss and system of fabricating a building that a cross brace is located between the two truss members.

Still yet another object of the present invention is to provide a truss and system of fabricating a building that attached at the lower ends of the truss members are sleeves.

A further object of the present invention is to provide a truss and system of fabricating a building wherein sleeve are attached to an end of the truss opposite the peak end for redirecting outward forces into a downward force on a top of a post.

Still another object of the present invention is to provide a truss and system of fabricating a building wherein the sleeve is designed to slide over the top of a post or column to attach and properly position the truss on the post or columns.

Another object of the present invention is to provide a truss and system of fabricating a building wherein vertical adjustment to level the truss is provided by vertical movement of the sleeve on the post.

Still another object of the present invention is to provide a truss and system of fabricating a building wherein all posts are positioned at a desired location and cut to a substantially level height, the trusses are lifted and placed on the posts with the sleeve fitting over the top of the posts and is secured on the posts with at least one of bolts and other fasteners.

Yet another object of the present invention is to provide a truss and system of fabricating a building that the truss of the present invention with the sleeve and this method allows a building to be constructed very rapidly and inexpensively.

Another object of the present invention is to provide a truss and system for fabricating a building for framing standard lumber to truss.

An even further object of the present invention is to provide a truss and system for fabricating a building including means for framing standard fascia and soffit material to outside brackets, and assembly with common hand tools.

Additional objects of the present invention will appear as the description proceeds.

The present invention overcomes the shortcomings of the prior art by providing a truss and system of fabricating a building using the truss system of the present invention. The truss is designed to span large widths without center support. Each truss structure is made with two symmetrical truss members that join at the peak joint. A cross brace is located between the two truss members. Attached at the lower ends of the truss members are sleeves. The sleeves are rigidly attached to the truss end and redirects outward forces into the top of posts in downward forces. The sleeves are designed to slide over the top of posts to attach and properly position the truss on the posts. Vertical adjustment to level the truss is provided by vertical movement of the sleeves on the posts. Once all posts are placed and cut to a generally level height, the trusses are lifted and placed on the posts with the sleeves fitting over the top of the posts. The sleeves, after being vertically adjusted, are secured on the posts with bolts, or other fasteners. The truss of the present invention with the sleeves and this method allows a building to be constructed very rapidly and inexpensively, can frame standard lumber to truss, frame standard fascia and soffit material to the outside brackets and can be assembled with common hand tools. A building having a large width or span with high overhead can be constructed in a very short time using the truss of the present invention and the system of fabricating a building with the truss.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
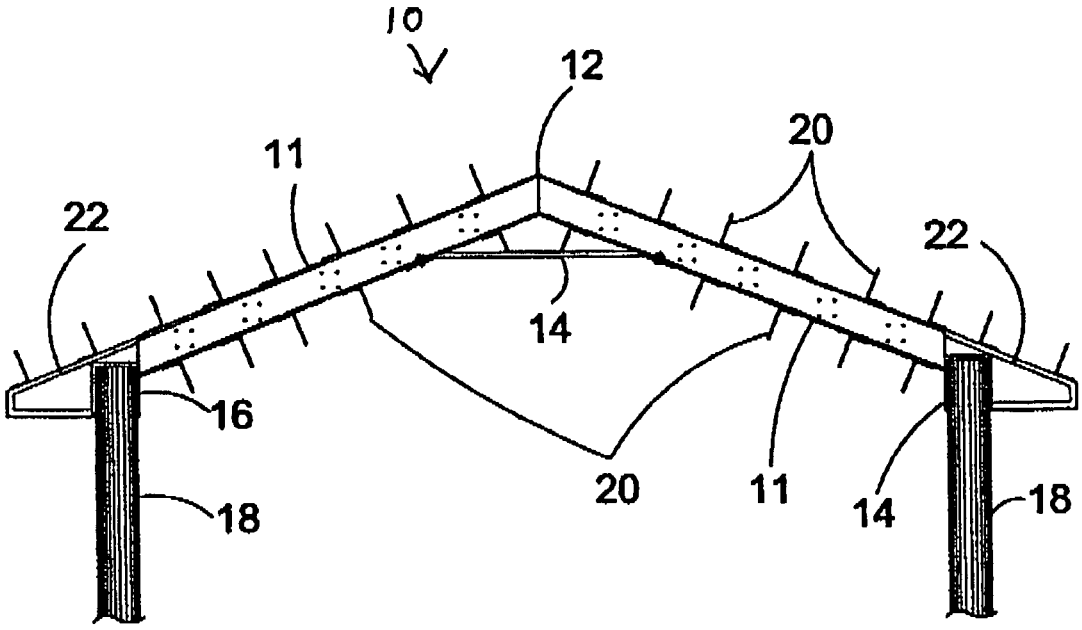
FIG. 1 is an illustrative view of the truss and a system for fabricating a building using the truss system of the present invention.

Turning now descriptively to the drawings, in which similar reference characters denote similar elements throughout the several views, the Figures illustrate the truss and system of fabricating a building using the truss system of the present invention. With regard to the reference numerals used, the following numbering is used throughout the various drawing Figures.

10 truss system of the present invention
11 truss member
12 peak joint
14 cross brace
16 sleeve
18 post
20 purlin mounts
22 soffit fascia bracket
24 weld
26 bolts
27 nuts
28 apertures

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

In the construction industry it is known that certain building fabricating features appeal to certain customers. The present invention relates to customers who desire roofing designs that span large widths without grounded center supports. It is known to those in the building fabricating industry that erecting such a structure is generally costly, time consuming, and requires special tools. The present invention aims to solve that problem with truss and a system for fabricating a building using the truss system.

FIG. 1 is an illustrative view of the truss and a system for fabricating a building using the truss system of the present invention. The truss system 10 of the present invention includes a plurality of truss members 11 connected to one another at a distal end thereof thereby forming a peak joint 12. A cross brace 14 attaches the two truss members 11 at an under side of the peak joint 12 thereby providing stability to the truss system 10 of the present invention. A sleeves 16 is secured to a distal end of the truss member 11 opposite the peak joint 12. The sleeve 16 is substantially "H" shaped and are designed to slide over a top end of a post 18 to attach and properly position the truss 10 thereon. The sleeves 16 are then secured to the posts with at least one of bolts 26 or other fasteners as will be shown hereinafter with specific reference to FIGS. 9 and 10.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, a soffit fascia brackets 22 is connected to each of the truss member 11 and the sleeve 16 which allows for sidings to be affixed to the resulting structure formed when using the truss system 10 of the present invention.

The two sleeves 16 redirect outward forces into downward forces at the connection of the sleeve 16 to the post 18. These downward forces are transferred to the ground where the post 18 is secured thereon. Alternatively, the posts 18 may be weighted so that the posts 18 need not be secured in the ground. Additionally, vertical adjustment to height of the truss members is provided by allowing vertical movement of the sleeves 16 along the posts 18. The truss members 11 are formed and are lifted and placed onto the posts 18 once all posts are positioned and leveled to substantially the same height.

Figure 2:
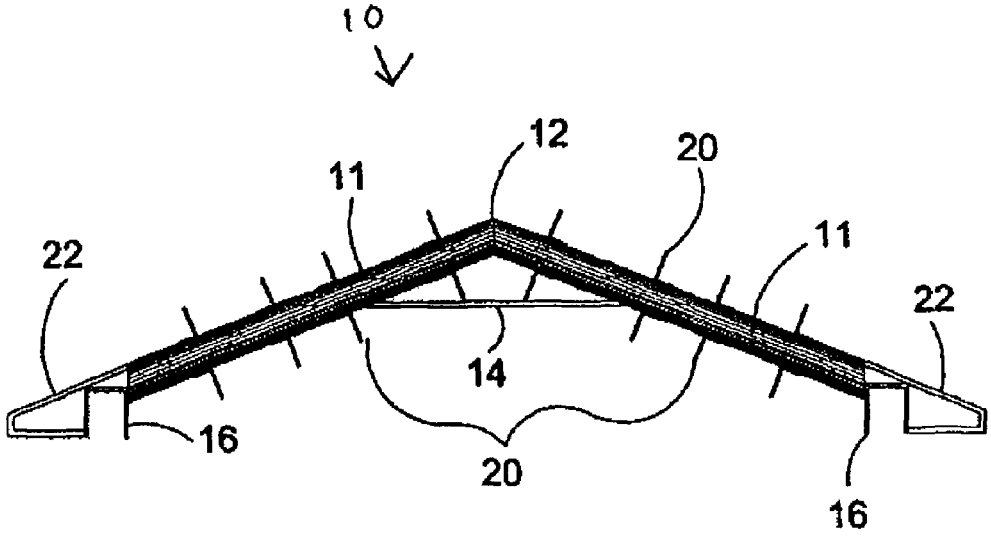
FIG. 2 is a frontal view of the truss and a system for fabricating a building using the truss system of the present invention.

FIG. 2 is a frontal view of the truss and a system for fabricating a building using the truss system of the present invention. The truss system 10 of the present invention includes a plurality of truss members 11 connected to one another at a distal end thereof thereby forming the peak joint 12. The cross brace 14 attaches the two truss members 11 at an under side of the peak joint 12 thereby providing stability to the truss system 10 of the present invention. Sleeves 16 are secured to a distal end of the truss member 11 opposite the peak joint 12. The sleeve 16 is substantially "H" shaped and are designed to slide over a top end of a post 18, as shown in FIG. 1, to attach and properly position the truss 10 thereon. The sleeves 16 are then secured to the posts with at least one of bolts 26 or other fasteners as will be shown hereinafter with specific reference to FIGS. 9 and 10.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, a soffit fascia brackets 22 is connected to each of the truss member 11 and the sleeve 16 which allows for sidings to be affixed to the resulting structure formed when using the truss system 10 of the present invention.

Figure 3:
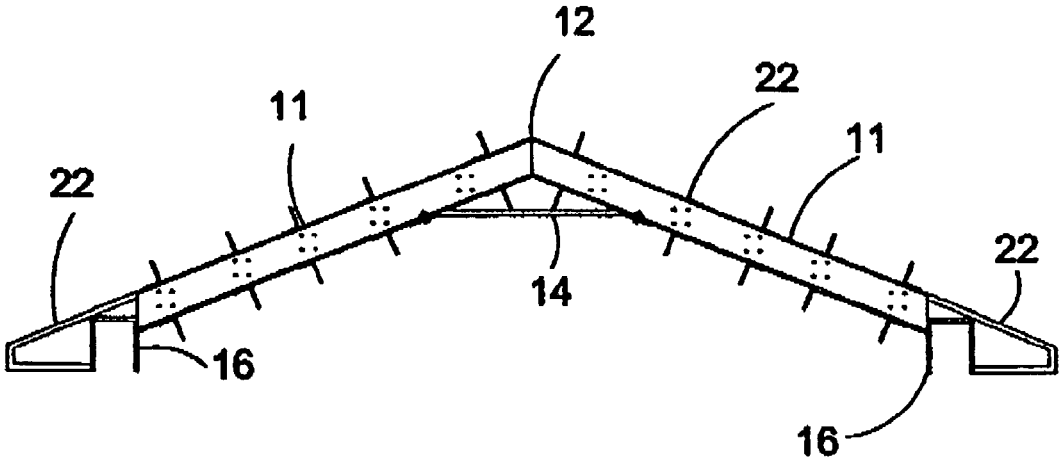
FIG. 3 is a rear view of the truss and a system for fabricating a building using the truss system of the present invention.

FIG. 3 is a rear view of the truss and a system for fabricating a building using the truss system of the present invention. The truss system 10 of the present invention includes a plurality of truss members 11 connected to one another at a distal end thereof thereby forming the peak joint 12. The cross brace 14 attaches the two truss members 11 at an under side of the peak joint 12 thereby providing stability to the truss system 10 of the present invention. Sleeves 16 are secured to a distal end of the truss member 11 opposite the peak joint 12. The sleeve 16 is substantially "H" shaped and are designed to slide over a top end of a post 18, as shown in FIG. 1, to attach and properly position the truss 10 thereon. The sleeves 16 are then secured to the posts with at least one of bolts 26 or other fasteners as will be shown hereinafter with specific reference to FIGS. 9 and 10.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, a soffit fascia brackets 22 is connected to each of the truss member 11 and the sleeve 16 which allows for sidings to be affixed to the resulting structure formed when using the truss system 10 of the present invention.

Figure 4:
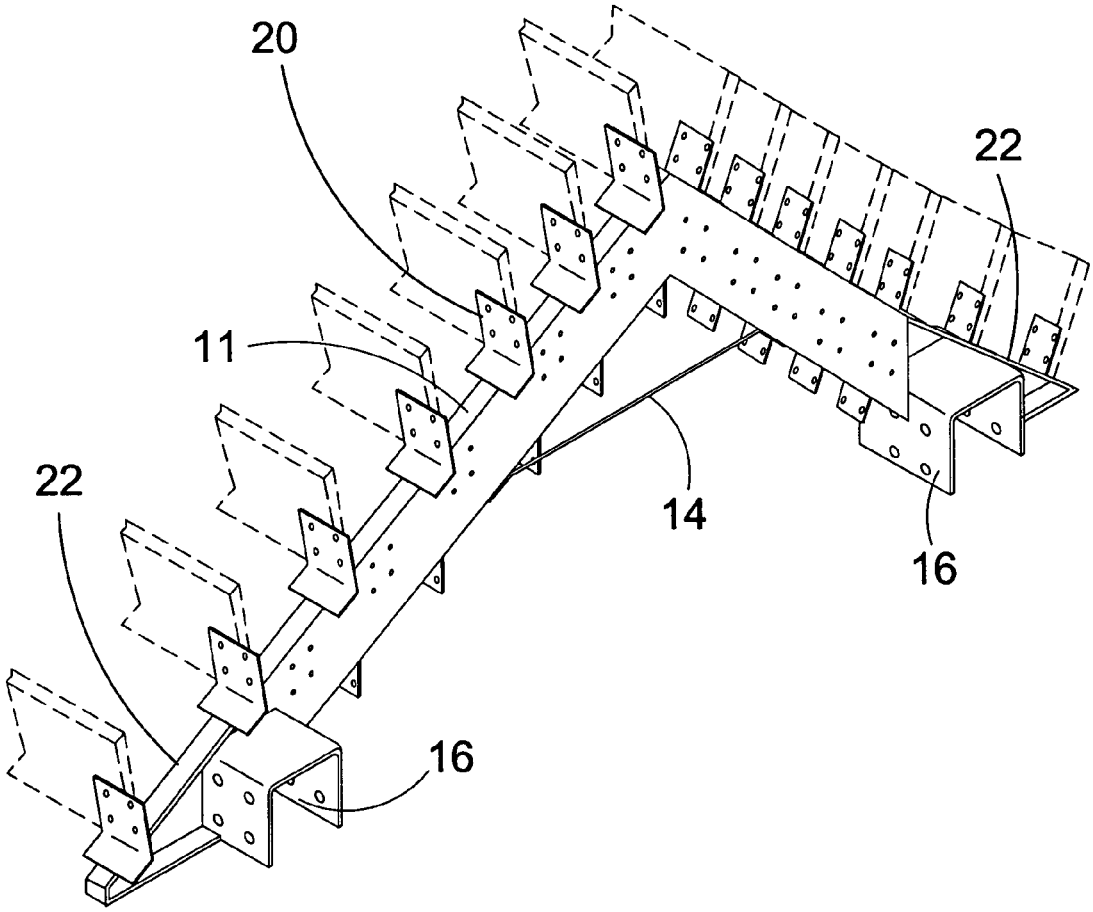
FIG. 4 is a perspective view of truss and a system for fabricating a building using the truss system of the present invention.

FIG. 4 is a perspective view of truss and a system for fabricating a building using the truss system of the present invention. The truss system 10 of the present invention includes a plurality of truss members 11 connected to one another at a distal end thereof thereby forming the peak joint 12. The cross brace 14 attaches the two truss members 11 at an under side of the peak joint 12 thereby providing stability to the truss system 10 of the present invention. Sleeves 16 are secured to a distal end of the truss member 11 opposite the peak joint 12. The sleeve 16 is substantially "H" shaped and are designed to slide over a top end of a post 18, as shown in FIG. 1, to attach and properly position the truss 10 thereon. The sleeves 16 are then secured to the posts with at least one of bolts 26 or other fasteners as will be shown hereinafter with specific reference to FIGS. 9 and 10.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, a soffit fascia brackets 22 is connected to each of the truss member 11 and the sleeve 16 which allows for sidings to be affixed to the resulting structure formed when using the truss system 10 of the present invention.

Figure 5:
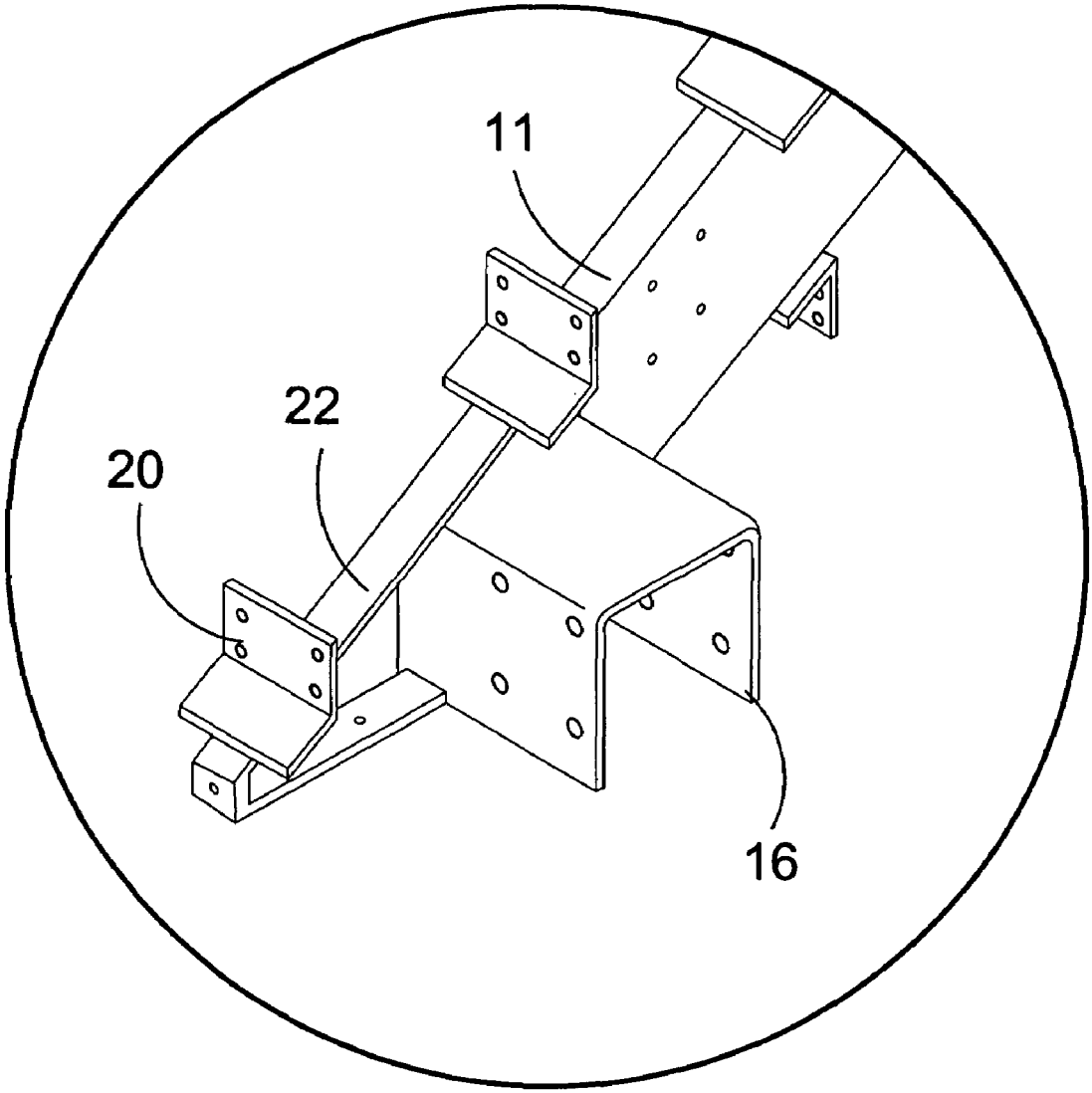
FIG. 5 is a detailed view of the truss, soffit fascia bracket and purlin mounts of the present invention attached to the sleeve.

FIG. 5 is a detailed view of the sleeve 16 and soffit fascia bracket 22 of the truss system of the present invention. The truss system 10 of the present invention includes a plurality of truss members 11 connected to one another at a distal end thereof thereby forming the peak joint 12 as is shown hereinabove with specific reference to FIGS. 1-4. The cross brace 14 attaches the two truss members 11 at an under side of the peak joint 12 thereby providing stability to the truss system 10 of the present invention as shown hereinabove with specific reference to FIGS. 1-4. Sleeves 16 are secured to a distal end of the truss member 11 opposite the peak joint 12. The sleeve 16 is substantially "H" shaped and are designed to slide over a top end of a post 18, as shown in FIG. 1, to attach and properly position the truss 10 thereon. The sleeves 16 are then secured to the posts with at least one of bolts 26 or other fasteners as will be shown hereinafter with specific reference to FIGS. 9 and 10.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, a soffit fascia brackets 22 is connected to each of the truss member 11 and the sleeve 16 which allows for sidings to be affixed to the resulting structure formed when using the truss system 10 of the present invention.

Figure 6:
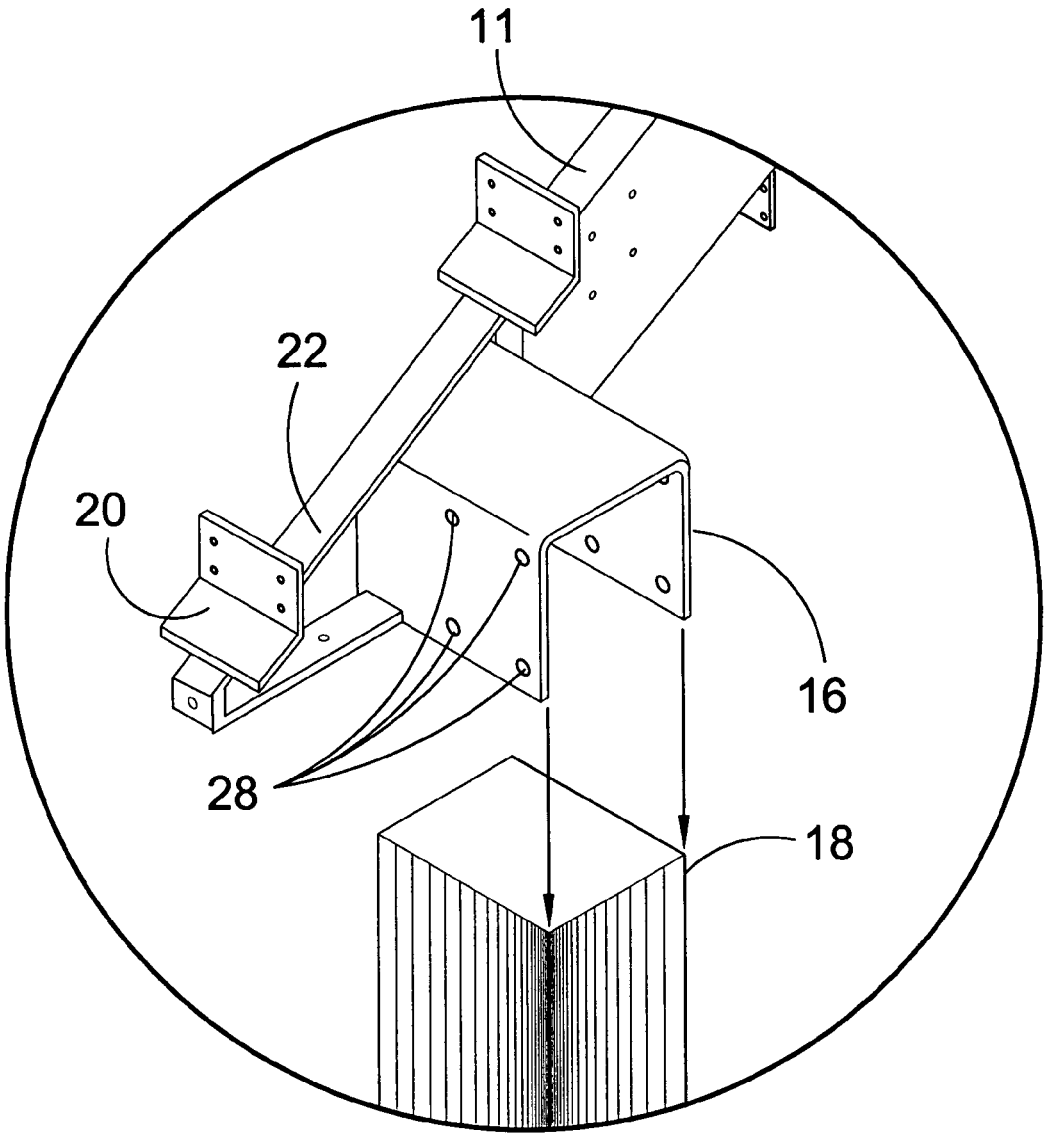
FIG. 6 is a detailed view of the truss, soffit fascia bracket, purlin mounts and sleeve of the present invention fitted to a post.

FIG. 6 is a detailed view of the truss system 10 of the present invention being mounted on posts 18 for support thereof. The truss system 10 of the present invention includes a plurality of truss members 11 connected to one another at a distal end thereof thereby forming the peak joint 12 as shown hereinabove with specific reference to FIGS. 1-4. The cross brace 14 attaches the two truss members 11 at an under side of the peak joint 12 thereby providing stability to the truss system 10 of the present invention as shown hereinabove with specific reference to FIGS. 1-4. The sleeves 16 is secured to a distal end of the truss member 11 opposite the peak joint 12. The sleeve 16 is substantially "H" shaped and are designed to slide over a top end of a post 18 to attach and properly position the truss 10 thereon. The sleeves 16 include a plurality of apertures 28 for receiving at least one of bolts 26 or other fasteners for securing the sleeve 16 to the post 18.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, the soffit fascia brackets 22 is connected to each of the truss member 11 and the sleeve 16 which allows for sidings to be affixed to the resulting structure formed when using the truss system 10 of the present invention.

The two sleeves 16 redirect outward forces into downward forces at the connection of the sleeve 16 to the post 18. These downward forces are transferred to the ground where the post 18 is secured thereon. Alternatively, the posts 18 may be weighted so that the posts 18 need not be secured in the ground. Additionally, vertical adjustment to height of the truss members is provided by allowing vertical movement of the sleeves 16 along the posts 18. The truss members 11 are formed and are lifted and placed onto the posts 18 once all posts are positioned and leveled to substantially the same height.

Figure 7:
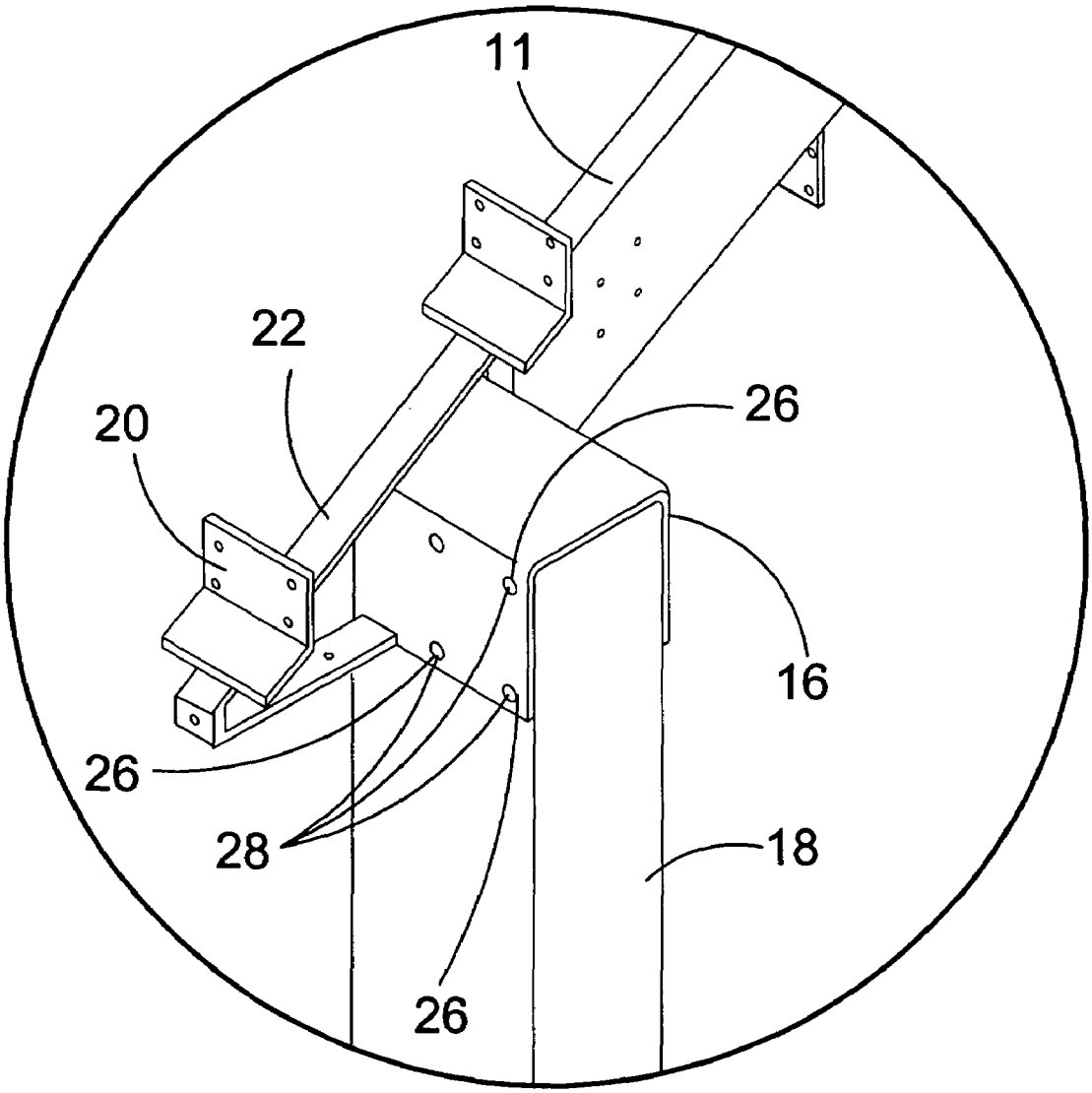
FIG. 7 is a detailed view of the truss, soffit fascia bracket, purlin mounts and sleeve of the present invention mounted onto a post.

FIG. 7 is a detailed view of the sleeve 16 of the truss system 10 of the present invention secured to the post 18. The truss system 10 of the present invention includes a plurality of truss members 11 connected to one another at a distal end thereof thereby forming the peak joint 12 as shown hereinabove with specific reference to FIGS. 1-4. The cross brace 14 attaches the two truss members 11 at an under side of the peak joint 12 thereby providing stability to the truss system 10 of the present invention as shown hereinabove with specific reference to FIGS. 1-4. The sleeves 16 is secured to a distal end of the truss member 11 opposite the peak joint 12. The sleeve 16 is substantially "H" shaped and are designed to slide over a top end of a post 18 to attach and properly position the truss 10 thereon. The sleeves 16 include a plurality of apertures 28 for receiving at least one of bolts 26 or other fasteners for securing the sleeve 16 to the post 18.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, the soffit fascia brackets 22 is connected to each of the truss member 11 and the sleeve 16 which allows for sidings to be affixed to the resulting structure formed when using the truss system 10 of the present invention.

The two sleeves 16 redirect outward forces into downward forces at the connection of the sleeve 16 to the post 18. These downward forces are transferred to the ground where the post 18 is secured thereon. Alternatively, the posts 18 may be weighted so that the posts 18 need not be secured in the ground. Additionally, vertical adjustment to height of the truss members is provided by allowing vertical movement of the sleeves 16 along the posts 18. The truss members 11 are formed and are lifted and placed onto the posts 18 once all posts are positioned and leveled to substantially the same height.

Figure 8:
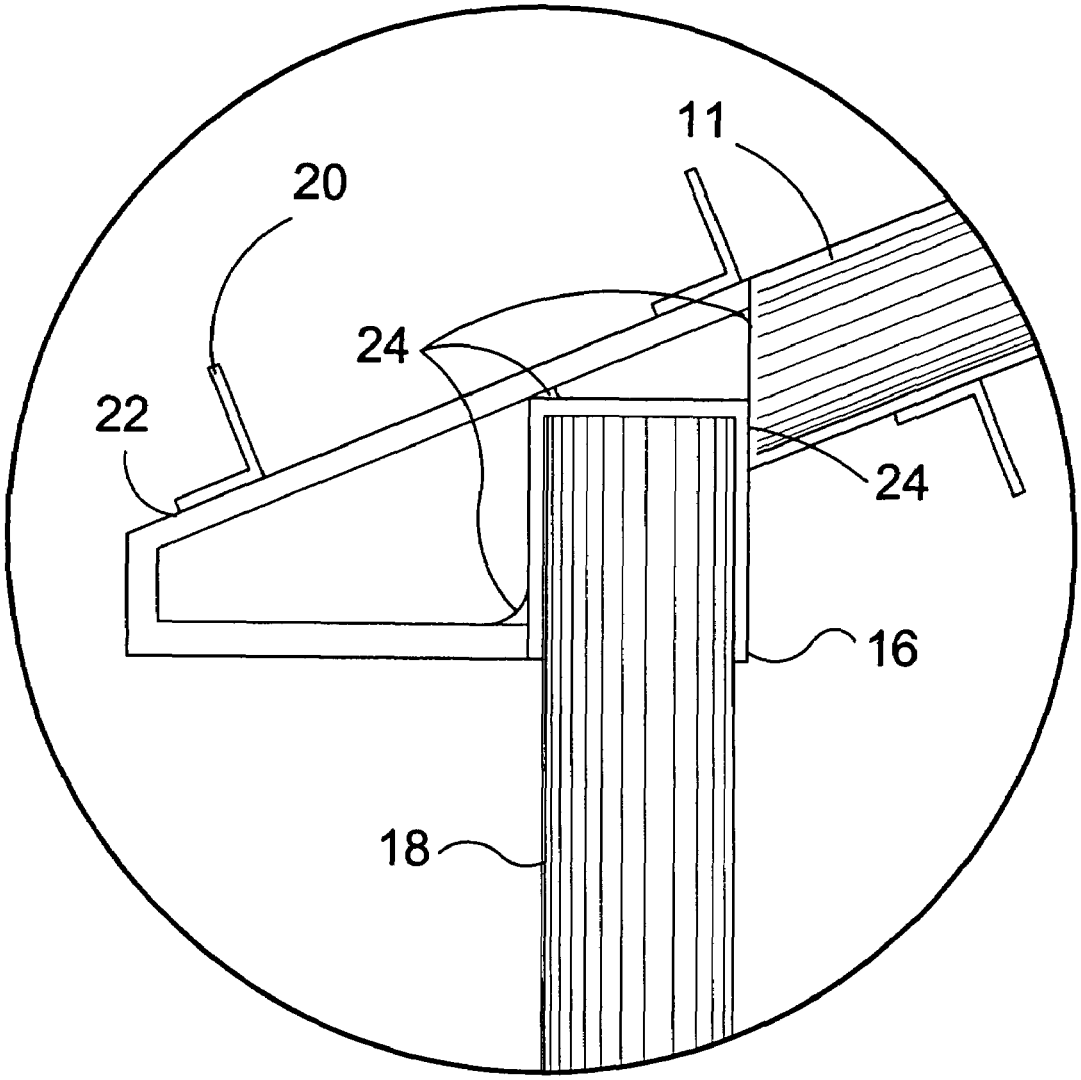
FIG. 8 is a sectional view of the truss, soffit fascia bracket, purlin mounts and sleeve of the present invention mounted onto a post.

FIG. 8 is a sectional view of the sleeve 16 secured to the truss member 11 of the truss system of the present invention. The truss system 10 of the present invention includes a plurality of truss members 11 connected to one another at a distal end thereof thereby forming the peak joint 12 as shown hereinabove with specific reference to FIGS. 1-4. The cross brace 14 attaches the two truss members 11 at an under side of the peak joint 12 thereby providing stability to the truss system 10 of the present invention as shown hereinabove with specific reference to FIGS. 1-4. The sleeves 16 is secured to a distal end of the truss member 11 opposite the peak joint 12. The sleeve 16 is substantially "H" shaped and are designed to slide over a top end of a post 18 to attach and properly position the truss 10 thereon. The sleeves 16 include a plurality of apertures 28 for receiving at least one of bolts 26 or other fasteners for securing the sleeve 16 to the post 18.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, the soffit fascia brackets 22 is connected to each of the truss member 11 and the sleeve 16 which allows for sidings to be affixed to the resulting structure formed when using the truss system 10 of the present invention.

As shown herein, the sleeve 16 is connected to the truss member 11 via at least one weld 24. Additionally, the soffit fascia bracket 22 is further shown connected to both the truss member 11 and the sleeve 16 by additional welds 24. By welding the sleeve 16, bracket 22 and truss member 11 together, a single unit is formed thereby allowing for increased support of the truss system 10 of the present invention. The result is a stronger building produced when using the trusses of the truss system 10 of the present invention.

The two sleeves 16 redirect outward forces into downward forces at the connection of the sleeve 16 to the post 18. These downward forces are transferred to the ground where the post 18 is secured thereon. Alternatively, the posts 18 may be weighted so that the posts 18 need not be secured in the ground. Additionally, vertical adjustment to height of the truss members is provided by allowing vertical movement of the sleeves 16 along the posts 18. The truss members 11 are formed and are lifted and placed onto the posts 18 once all posts are positioned and leveled to substantially the same height.

Figure 9:
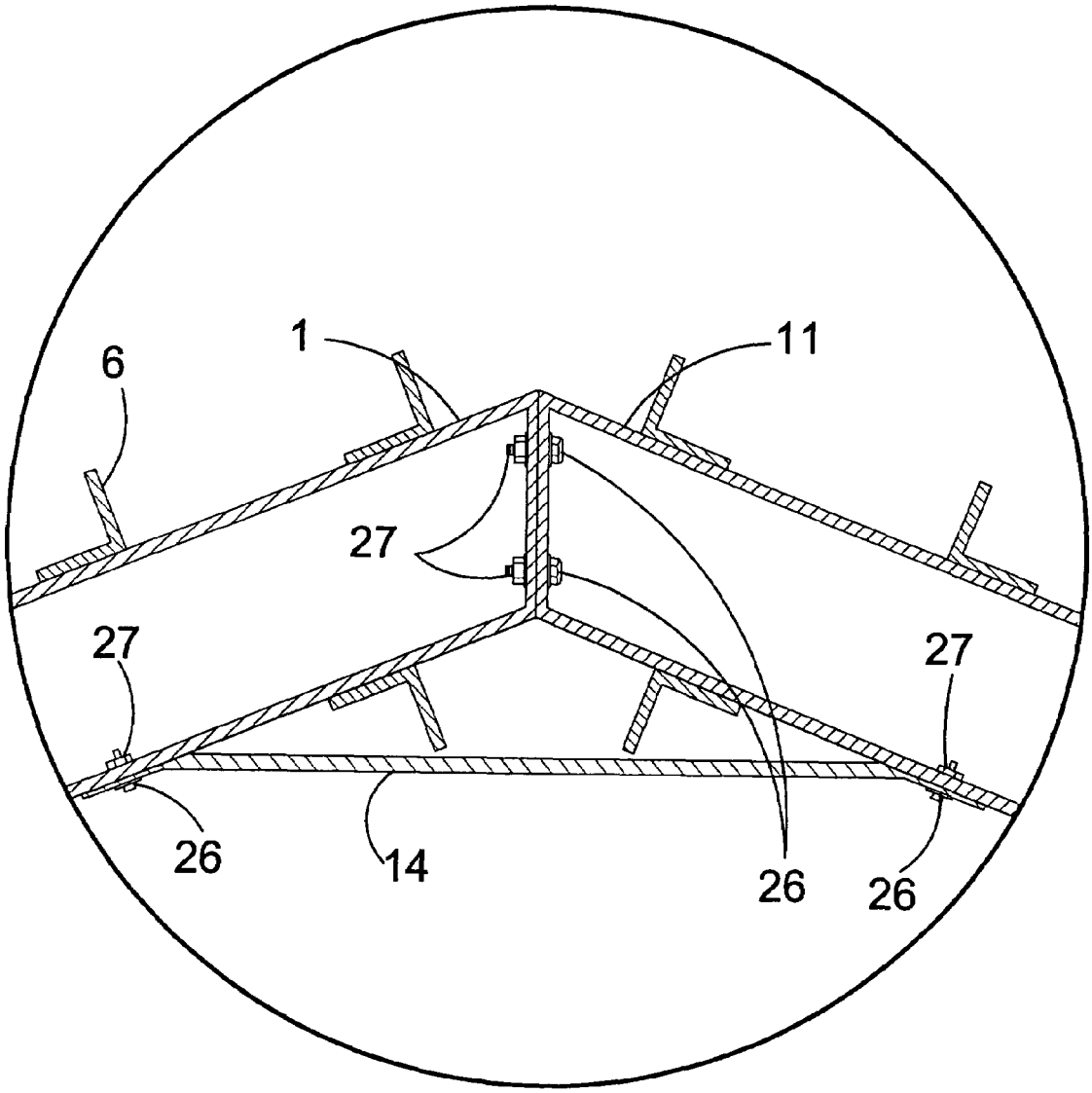
FIG. 9 is a sectional view of two truss members of the truss system of the present invention attached by and stabilized by a cross brace.

FIG. 9 is a sectional view of two truss members 1 attached by washers, nuts and bolts 9 and stabilized by a cross brace underneath 2. The truss system 10 of the present invention includes a plurality of truss members 11 connected to one another at a distal end thereof thereby forming the peak joint 12. The peak joint 12 is formed by securing the distal ends of the truss members 11 to one another by at least one of bolts 26 secured by nuts 27 and any additional fasteners. These fasteners include but are not limited to welds 24 as shown in FIGS. 6 and 7 which secure the sleeve 16, truss member 11 and bracket 22. Preferably, the peak joint 12 is formed connecting the truss members 11 at a plurality of locations thereby forming a stiff, immobile peak joint 12.

The cross brace 14 provides support for the peak joint 12 and is connected to each of the two truss members 11 at an under side of the peak joint 12 thereby providing stability to the truss system 10 of the present invention. The cross brace 14 is also connected to the truss members 11 via at least one of bolts 26 secured in place by nuts 27 and additional fasteners. Upon securing the cross brace 14, the peak joint is stabilized thereby providing support for the roof of the resulting building.

Figure 10:
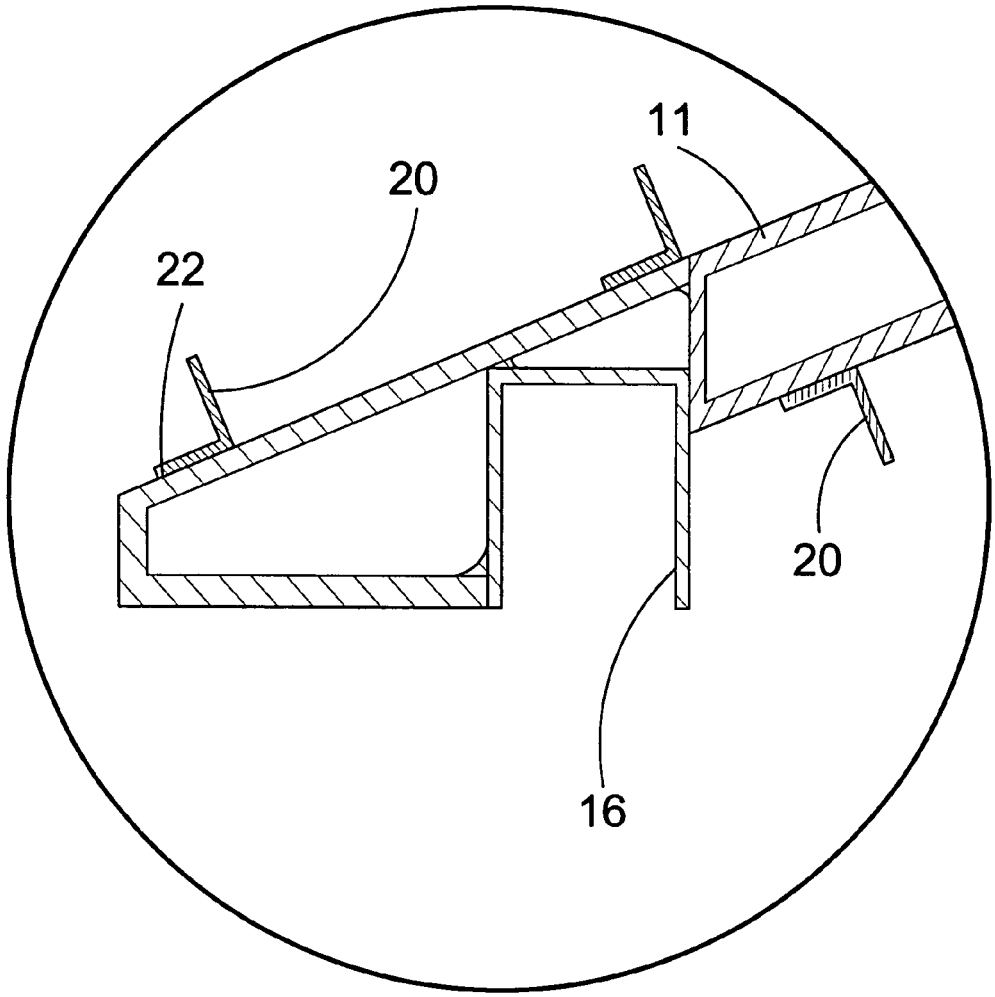
FIG. 10 is a sectional view of the truss, soffit fascia bracket, purlin mounts and sleeve of the present invention.

FIG. 10 is a sectional view of the sleeve 16 of the truss system 10 of the present invention. The truss system 10 of the present invention includes a plurality of truss members 11 connected to one another at a distal end thereof thereby forming the peak joint 12 as shown hereinabove with specific reference to FIGS. 1-4. The cross brace 14 attaches the two truss members 11 at an under side of the peak joint 12 thereby providing stability to the truss system 10 of the present invention as shown hereinabove with specific reference to FIGS. 1-4. The sleeves 16 is secured to a distal end of the truss member 11 opposite the peak joint 12. The sleeve 16 is substantially "H" shaped and are designed to slide over a top end of a post 18 to attach and properly position the truss 10 thereon. The sleeves 16 include a plurality of apertures 28 for receiving at least one of bolts 26 or other fasteners for securing the sleeve 16 to the post 18.

Positioned along top and bottom surfaces of the truss members 11 are a plurality of even spaced purlin mounts 20 that allow timber or other roofing material to be positioned horizontally thereon. These purlin mounts 20 include means for securing roofing material to the truss members 11. Additionally, the soffit fascia brackets 22 is connected to each of the truss member 11 and the sleeve 16 which allows for sidings to be affixed to the resulting structure formed when using the truss system 10 of the present invention.

As shown herein, the sleeve 16 is connected to the truss member 11 via at least one weld 24. Additionally, the soffit fascia bracket 22 is further shown connected to both the truss member 11 and the sleeve 16 by additional welds 24. By welding the sleeve 16, bracket 22 and truss member 11 together, a single unit is formed thereby allowing for increased support of the truss system 10 of the present invention. The result is a stronger building produced when using the trusses of the truss system 10 of the present invention.

The two sleeves 16 redirect outward forces into downward forces at the connection of the sleeve 16 to the post 18. These downward forces are transferred to the ground where the post 18 is secured thereon. Alternatively, the posts 18 may be weighted so that the posts 18 need not be secured in the ground. Additionally, vertical adjustment to height of the truss members is provided by allowing vertical movement of the sleeves 16 along the posts 18. The truss members 11 are formed and are lifted and placed onto the posts 18 once all posts are positioned and leveled to substantially the same height.

It will be understood that each of the elements described above, or two or more together may also find a useful application in other types of methods differing from the type described above.

Preferably, the truss members 11 and the sleeves 16 are formed from steel thereby providing greater support to the resulting building structure as well as allowing the resulting building structure to be formed in segments and combined and connected to one another to form the resulting building. However, the truss system 10 may be formed using any material that is strong and lightweight that is also easily maneuverable.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A truss system for use in constructing a building structure comprising:

a) A first and second truss member connected to one another at a distal end of each truss member forming a peak joint where the distal ends come together;

b) A cross bar connected to each of said first and second truss members at an under side of said peak joint; and c) a sleeve connected to each truss member at a lower end opposite said peak joint forming a truss unit, each said sleeve having a bottom opening for receiving a top of a post, each sleeve having an inner side attached to a truss member and an outer side facing outwardly; and d) a bracket mounted on an outer side of each sleeve, said bracket having a horizontal leg with one end attached to said sleeve and a diagonally extending leg having one end attached to an opposite end of said horizontal leg and an opposite end of said diagonal extending leg attached to an upper side of the truss member attached to said sleeve, and intermediate portion of said diagonally extending leg of said bracket being welded to a corner of said sleeve.

2. The system as recited in claim 1, further comprising a plurality of purlin mounts positioned along a length of each of a top and bottom side of said first and second truss members.

3. The system as recited in claim 2, wherein said purlin mounts allow for at least one of timber and roofing tiles to be mounted to said first and second truss members.

4. The system as recited in claim 3, wherein a plurality of truss units are positioned so that said purlin mounts are aligned thereby allowing for horizontal positioning and securing of timber and roofing tiles on said truss units.

5. The system as recited in claim 1, wherein said peak joint is formed by securing said first and second truss members to one another using a plurality of bolts.

6. The system as recited in claim 1, wherein said cross bar is connected to each of said first truss member and said second truss member by bolts.

7. A method of constructing a structure using a truss system comprising the activities of:

a) Constructing a plurality of truss units, each respective truss unit comprises:

i. A first and second truss member connected to one another at a distal end of each truss member forming a peak joint where the distal ends come together;

ii. A cross bar connected to each of the first and second truss members at an under side of the peak joint;

iii. a sleeve connected to each truss member at a lower end opposite said peak joint form a truss unit, each said sleeve having a bottom opening for receiving a top of a support member, each sleeve having an inner side attached to a truss member and an outer side facing outwardly; and iv. a bracket mounted on an outer side of each sleeve, said bracket having a horizontal leg with one end attached to said sleeve and a diagonally extending leg having one end attached to an opposite end of said horizontal leg and an opposite end of said diagonally extending leg attached to an upper side of the truss member attached to said sleeve, and intermediate portion of said diagonally extending leg of said bracket being welded to a corner of said sleeve;

b) installing a plurality of support members into the ground according to a predetermined design corresponding to a desired shape and size of said structure;

c) positioning the truss unit on respective support members;

d) securing the plurality of truss units to one another; and e) securing the support members to one another thereby forming the desired structure.

8. The method as recited in claim 7, wherein the truss unit further comprise a plurality of purlin mounts positioned along a length of each of the first and second truss members on each of a top and bottom side thereof.

9. The method as recited in claim 7, wherein said activity of positioning further comprises horizontally aligning said plurality of purlin mounts.

10. The method as recited in claim 7, wherein said activity of positioning further comprises aligning said brackets on each of said truss units.

11. The method as recited in claim 9, further comprising the activity of securing at least one of timber and roofing materials to each of the aligned rows of purlin mounts.

* * * * *